US005584939A

United States Patent [19]

Dahlin et al.

[11] Patent Number: 5,584,939

[45] Date of Patent: Dec. 17, 1996

[54] METHOD FOR CLEANING RAIL CARS

[75] Inventors: Bill Dahlin, Fargo; Bill Pladson, Dickinson, both of N. Dak.; Billy W. Barnett, North Richland Hills, Tex.; Robert J. Luedders, Fort Worth, Tex.; Rod B. Allred, North Richland Hills, Tex.; James L. Kohtz, Bedford, Tex.; David C. Albright, Haslet, Tex.

[73] Assignee: Burlington Northern Railroad, Fort Worth, Tex.

[21] Appl. No.: 183,553

[22] Filed: Jan. 18, 1994

[51] Int. Cl.[6] ..... B08B 5/00; B08B 5/04; B08B 9/093; B24C 1/00

[52] U.S. Cl. ..... 134/7; 134/8; 134/21; 134/22.1; 134/22.18; 134/25.3; 134/37; 451/38; 451/39; 451/76; 15/345

[58] Field of Search ..... 134/6, 7, 8, 21, 134/22.1, 22.18, 25.3, 37; 451/38, 39, 76; 15/345

[56] References Cited

U.S. PATENT DOCUMENTS

| | | | |
|---|---|---|---|
| 2,622,047 | 12/1952 | Ayers | 134/7 |
| 2,677,629 | 5/1954 | Buck | 134/21 |
| 3,424,616 | 1/1969 | Townsend | 451/39 |
| 3,485,671 | 12/1969 | Stephens | 134/21 |
| 4,115,896 | 9/1978 | Costanzo | 134/21 |
| 4,454,823 | 6/1984 | Stoller, Sr. et al. | 105/423 |
| 4,473,409 | 9/1984 | Greeley | 134/21 |
| 5,308,404 | 5/1994 | Yam et al. | 134/6 |

FOREIGN PATENT DOCUMENTS

| | | | |
|---|---|---|---|
| 449822 | 7/1948 | Canada | 134/7 |

*Primary Examiner*—Zeinab El-Arini

*Attorney, Agent, or Firm*—R. Darryl Burke; Worsham, Forsythe & Wooldridge, L.L.P.

[57] ABSTRACT

Cleaning methods for rail cars that haul freight, such as covered hoppers, open hoppers, box cars, tank cars, autoracks, locomotives, flat cars, remove the residue from materials transported by the rail car itself. The rail cars have at least one surface. Freight includes, but is not limited to, agricultural products, industrial products, foodstuffs, living beings, and packaged goods. Methods include the steps of vacuuming excess materials remaining in rail car, removing clinging or otherwise persistent materials with a forced air system, which may be augmented with abrasive materials to a surface of the rail car, and vacuuming up or otherwise removing all remaining dust and debris, and repeating some or all of the steps as necessary. In addition, methods wipe down the surface with a dry rag (e.g., paper or cloth) and/or wipe down the surface with a damp rag. A rag could also be used to apply a sterilizing agent, which would depend upon the application and materials removed and shipped.

27 Claims, 11 Drawing Sheets

METHOD FOR CLEANING RAIL CARS

PARTIAL WAIVER OF COPYRIGHT
PURSUANT TO 1077 O.G. 22(Mar. 20, 1987)

(C) Copyright, Burlington Northern Railroad 1994. All of the material in this patent application is subject to copyright protection under the copyright laws of the United States and of other countries. As of the first effective filing date of the present application, this material is protected as unpublished material.

However, permission to copy this material is hereby granted to the extent that the owner of the copyright and maskwork rights has no objection to the facsimile reproduction by anyone of the patent document or patent disclosure, as it appears in the United States Patent and Trademark Office patent file or records, but otherwise reserves all copyright and maskwork rights whatsoever.

FIELD OF INVENTION

The present invention relates generally to cleaning rail cars and, more particularly, but not by way of limitation, relates to blasting methods and machinery and sanitary technology.

BACKGROUND

Rail cars (e.g., covered hoppers, open hoppers, box cars, tank cars, autoracks, passenger cars, locomotives, and flat cars) transport a wide variety of materials, such as agricultural products (e.g., fertilizer), industrial products (e.g., sand, cement, petroleum coke products, dry petroleum products, limestone, soda ash and pot ash), foodstuffs (e.g., grain products, vegetables, sugar, flour, bentonite, sunflower seeds, and flax), animate objects, such live animals, and packaged goods, which typically leave a residue in the rail car when the bulk of these materials are removed from the rail car itself. Sugar, flour, and fertilizer, for instance, often stick to interior and exterior surfaces of rail cars. This residue contaminates future shipments and removing it is integral to preventing the contamination of future shipments, maintaining the overall condition of the rail car itself and complying with health code requirements and the like.

Traditional cleaning systems and methods for rail cars use liquid cleaning solutions to wash and clean rail cars, which pose a significant number of problems. Liquid cleaning solutions use considerable amounts of water. Liquid cleaning solutions are difficult to properly handle and control. Liquid cleaning solutions dissolve the remaining residue and impurities and subsequently carry these pollutants. In many cases, liquid cleaning solutions simply drain off rail cars and into the sewer system, the drainage system, or the railyard itself, which pollutes the environment. In other cases, liquid cleaning solutions drain into collecting ponds, which are used by some railroads, but handling the leftover sludge is a problem as well, as it cannot be recycled, separated, or easily disposed. In fact, in light of these environmental problems, government officials and agencies have encouraged the railroad industry to develop alternative procedures to clean rail cars and tightened regulations governing the disposal of liquid cleaning solutions. In addition, liquid cleaning solutions are difficult to handle, because they freeze at temperatures that commonly exist in Northern climates in the fall, winter, and spring seasons. Liquid cleaning solutions can also damage rail cars by seeping into various cracks and crevices and freezing and/or by rusting the actual rail car itself. Moreover, if possible, cleaning procedures and systems using liquid cleaning solutions must dry surfaces cleaned with liquid cleaning solutions with portable heaters and fans or by exposing the cleaned surfaces to the environment. Heaters and fans are expensive and cumbersome. Drying rail cars outside takes several days and enables insects and rodents to enter rail cars. In particular, canvass surfaces are extremely difficult to dry. If canvass surfaces are not completely dried, they provide a moist surface for mold, bacteria, and mildew. Finally, liquid cleaning solutions are generally ineffective in cleaning oily materials from rail cars. Liquid cleaning solutions that are effective in cleaning oily materials generally leave a residue that contaminates rail cars that must be removed as well.

SUMMARY OF THE INVENTIONS

The present invention provides cleaning systems and methods for cleaning rail cars (e.g., covered hoppers, open hoppers, box cars, tank cars, autoracks, passenger cars, locomotives, and flat cars, etc.) having at least one surface (e.g., exterior and interior). The disclosed invention removes the residue from materials transported by the rail car itself. For example, a list of these materials includes agricultural products (e.g., fertilizer), industrial products (e.g., sand, cement, petroleum coke products, dry petroleum products, limestone, soda ash and pot ash), foodstuffs (e.g., grain products, vegetables, sugar, flour, bentonite, sunflower seeds, and flax), animate objects such as live animals, and packaged goods. The residue is typically left in the rail car when the bulk of these materials are removed from the rail car itself.

Preferred system embodiments generally comprise vacuuming machinery to vacuum a material positioned on the surface(s) of the rail car and blasting machinery to create a force to exert air and/or an abrasive media against the material positioned on the surface(s) of the rail car to dislodge the material from the surface(s) of the rail car. The blasting equipment comprises a pressure system to produce forced air and a collector to collect and funnel the air and/or the abrasive media, so that the blasting equipment can apply the force to the media. As a result, the blasting equipment applies a force on the abrasive media, so that the abrasive media is propelled from the blasting equipment toward and against the surface of the rail car at a high velocity. The blasting equipment may also comprise a first hose to direct the media exerted against the material positioned on the surface(s) of the rail car and a second hose to vacuum the material dislodged by the abrasive media. The first hose and the second hose are preferably tied together. The hose is preferably flexible and comprised of a rubber material to allow an operator to spray the material on the media on the surface(s) of the rail car in a crossed pattern (e.g., side-to-side motion combined with top-to-bottom or back-and-forth, left-to-right, up-and-down) at an angle of approximately 5 to 90 degrees. It is important to continually sweep or move the spray of abrasive materials, so as to not damage the rail car (especially rail cars with an interior lining). Large capacity vacuum systems via vacuuming machinery provide a suction of approximately 1,000 to 2,500 c.f.m., but may be adjusted depending upon operating conditions and requirements. The preferred abrasive media is generally circular beads, droplets, or grains. The beads preferably have a smooth, outer surface for most applications to minimize damage to the surface cleaned. The beads, however, may have a sharp or rough outer surface for some applications. The abrasive media is generally comprised of sand, silica sand, gravel, limestone, birdseed, walnut, wheat, granite, sugar, mill tailings, dry ice, steel, plastic, rubber, and any combination thereof. In certain situations, the media can be reused in subsequent cleaning operations. The force used is approximately 85 to 150 p.s.i., but may be adjusted depending upon operating conditions and requirements. For instance, a lower force of approximately 85 p.s.i. is used for cars with an interior lining. The vacuum equipment and blasting equipment can be combined into a single unit or system to make the disclosed systems and processes more efficient.

Preferred methods generally comprise the following steps: removing excess debris remaining in rail car, removing clinging or otherwise persistent debris with a forced air system that applies abrasive materials to the surface(s) (e.g., interior and exterior) of the rail car. In addition, the additional step of vacuuming up or otherwise removing all remaining dust and debris may be included. The surface of the rail car can also be wiped down with a dry rag (e.g., paper or cloth) and a damp rag. A rag could also be used to apply a sterilizing agent, which would depend upon the application and materials removed and shipped. A list of preferred sterilizing agents includes (e.g., Sana T 10 or comparable, approved, food-grade cleansers). Any and all of the steps recited above can be repeated as necessary.

The disclosed systems and methods work on a wide variety of rail cars (e.g., covered hoppers, open hoppers, box cars, tank cars, autoracks, passenger cars, locomotives, and flat cars, etc.) having at least one surface (e.g., exterior and interior). The types of covered hoppers include covered hoppers equipped with airslide and gravity pneumatic system to remove the material from the rail car itself. The types of open top hoppers include coal cars, ballast cars, and ore cars. These rail cars are generally manufactured from a wide variety of materials, including steel, iron, aluminum, fiber glass, canvass, and plastics, which are used to form the main structure as well as any needed attachments.

The disclosed systems and methods have a number of advantages in that they are versatile and environmentally friendly. Given the fact the disclosed systems and methods are dry, they avoid problems traditionally encountered with methods and systems that use liquid cleaning solutions, which were discussed above. The disclosed systems and methods save water. In addition, since the dry media used does not freeze, many of the cold weather problems are avoided. The dry media is also easier to handle, control, and dispose. The dry media can be recycled and reused. The disclosed systems and methods collect the materials more easily. In addition, rail cars that are cleaned using the disclosed methods and systems do not need to be left open or exposed to the environment to allow the water and/or liquid solutions to evaporate, which prevents insects and rodents from entering the rail car during the interim and reduces the overall cleaning time of the rail cars. Rail cars generally take two to three days to dry in the winter, but have been known to take up to two weeks in the winter to properly dry. As a result, customers often "over-ordered" rail cars to compensate for the extra expected cleaning time and high rejection rates of traditional water-based methods and systems, which adversely affected scheduling efforts. The disclosed systems and methods have been found to cut the rail car rejection rate for some of its customers in half. The disclosed systems and methods are also more effective than traditional cleaning systems. In light of the difficulties associated with drying liquid cleaning solutions, some surfaces, such as surfaces covered with canvass, were not always dried completed, which allowed mold, mildew, and bacteria to build up on these surfaces. So, the disclosed systems and methods also reduce mold, mildew, and bacteria buildup.

BRIEF DESCRIPTION OF THE DRAWINGS

Further features and advantages will become apparent from the following and more particular description of the various embodiments of the invention, as illustrated in the accompanying drawings, wherein.

DETAILED DESCRIPTION OF THE PREFERRED EMBODIMENTS

Figure 1:
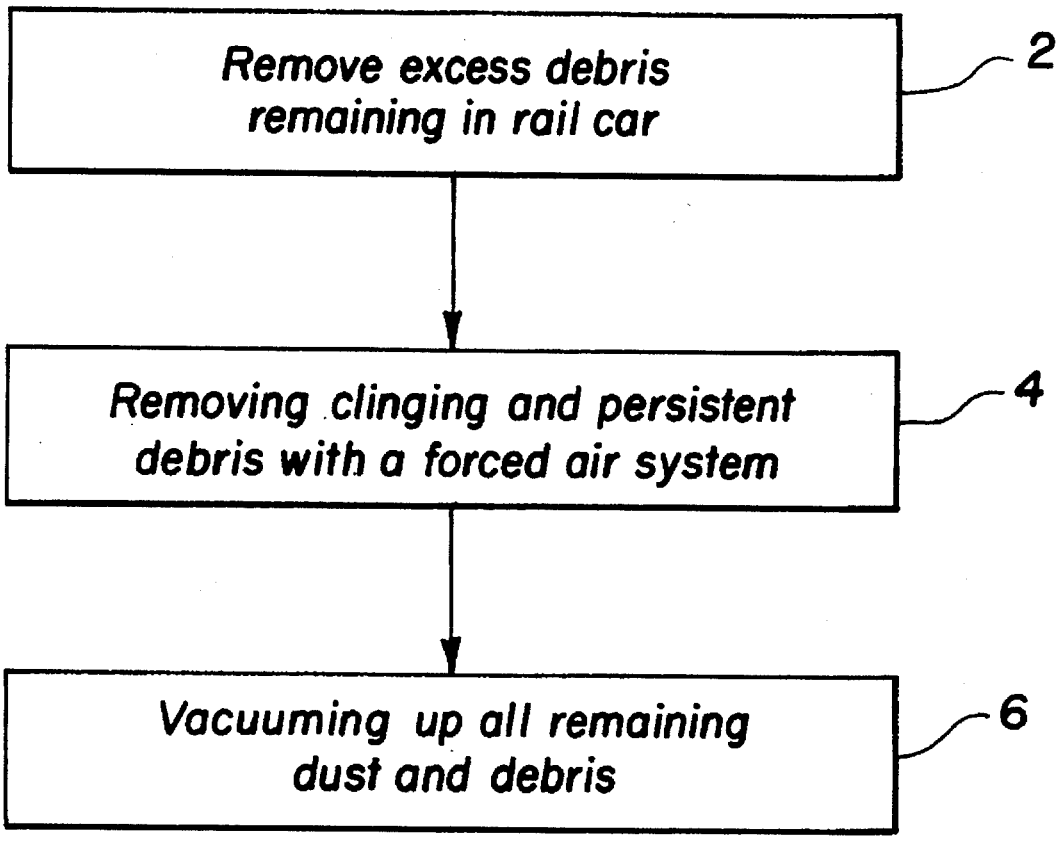
FIG. 1 is flow chart showing the primary steps used to clean rail cars.

FIG. 1 is a flow chart showing the primary steps used to clean rail cars (e.g., covered hoppers, open hoppers, box cars, tank cars, autoracks, passenger cars, locomotives, and flat cars, etc.). The new and improved method generally comprises the following steps: removing excess debris remaining in rail car 2, removing clinging or otherwise persistent debris with a forced air system that applies abrasive materials to the surface(s) (e.g., interior and exterior) of the rail car 4, vacuuming up or otherwise removing all remaining dust and debris 6, and repeating some or all of the steps as necessary. In addition, the surface(s) of the rail car can be wiped down with a rag (e.g., paper or cloth), which may be either damp or dry, in an additional step that is not shown in FIG. 1. A rag could also be used to apply a sterilizing agent (e.g., Sana T 10 or comparable, approved, food-grade cleansers).

Figure 2A:
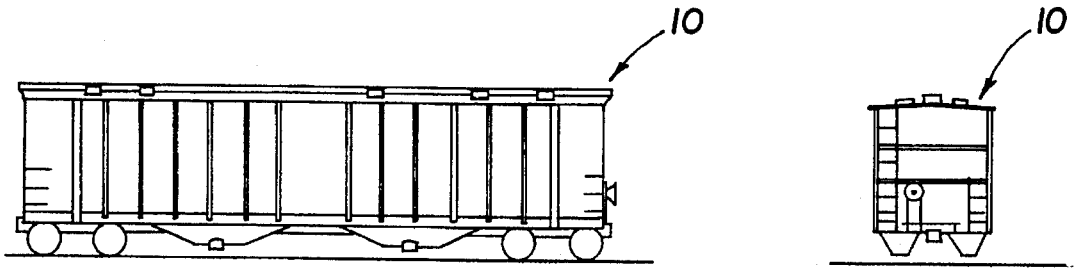
FIGS. 2A and 2B are representative illustrations of covered hopper rail cars that the disclosed cleaning systems and methods clean.
Figure 2B:
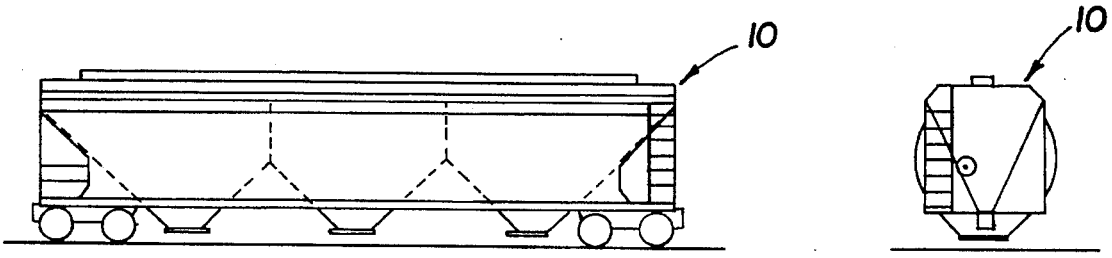

FIGS. 2A and 2B generally show the types of covered hopper rail cars 10 that the disclosed cleaning systems and methods clean. FIG. 2A shows a typical covered hopper rail cars 10 equipped with an airslide to remove the contents in rail car 10. FIG. 2B shows a typical covered hopper rail cars 10 equipped with center flow mechanism. Materials transported in covered hopper rail cars 10 are not to be typically exposed to the environment. FIGS. 2A and 2B show the dimensions of these cars that illustrates the sheer size of rail cars themselves as well as the extent of the cleaning procedures needed to clean covered hopper rail cars 10 and as well as other similar rail cars 12 and 20 (in FIGS. 3A, 3B, 3C, 4A, 4B, 4C, 5A, 5B, 6, 7A, and 7B).

Figure 3A:
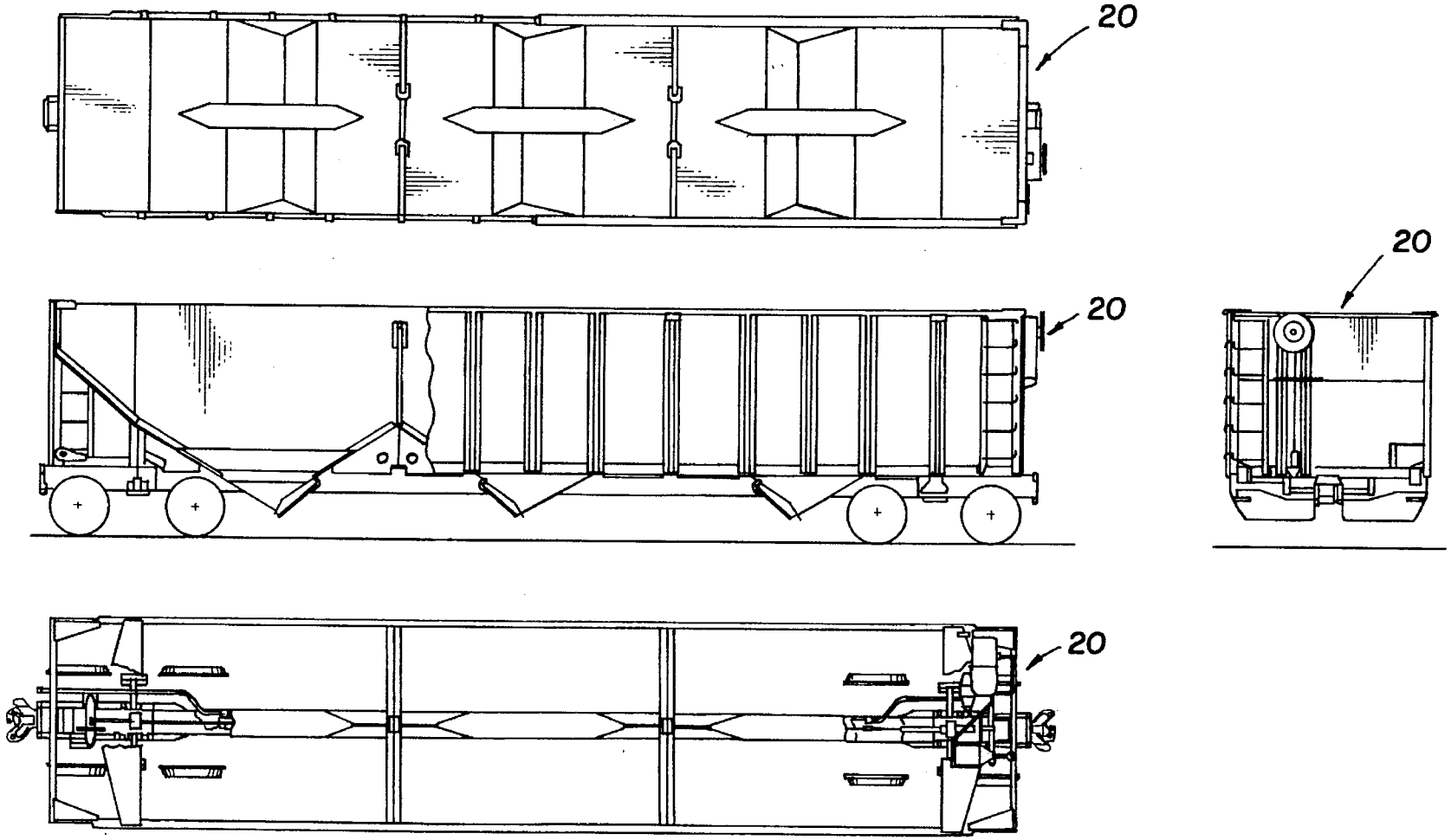
FIGS. 3A, 3B, and 3C are representative illustrations of the types of open top hoppers, box cars, and tank cars.
Figure 3B:
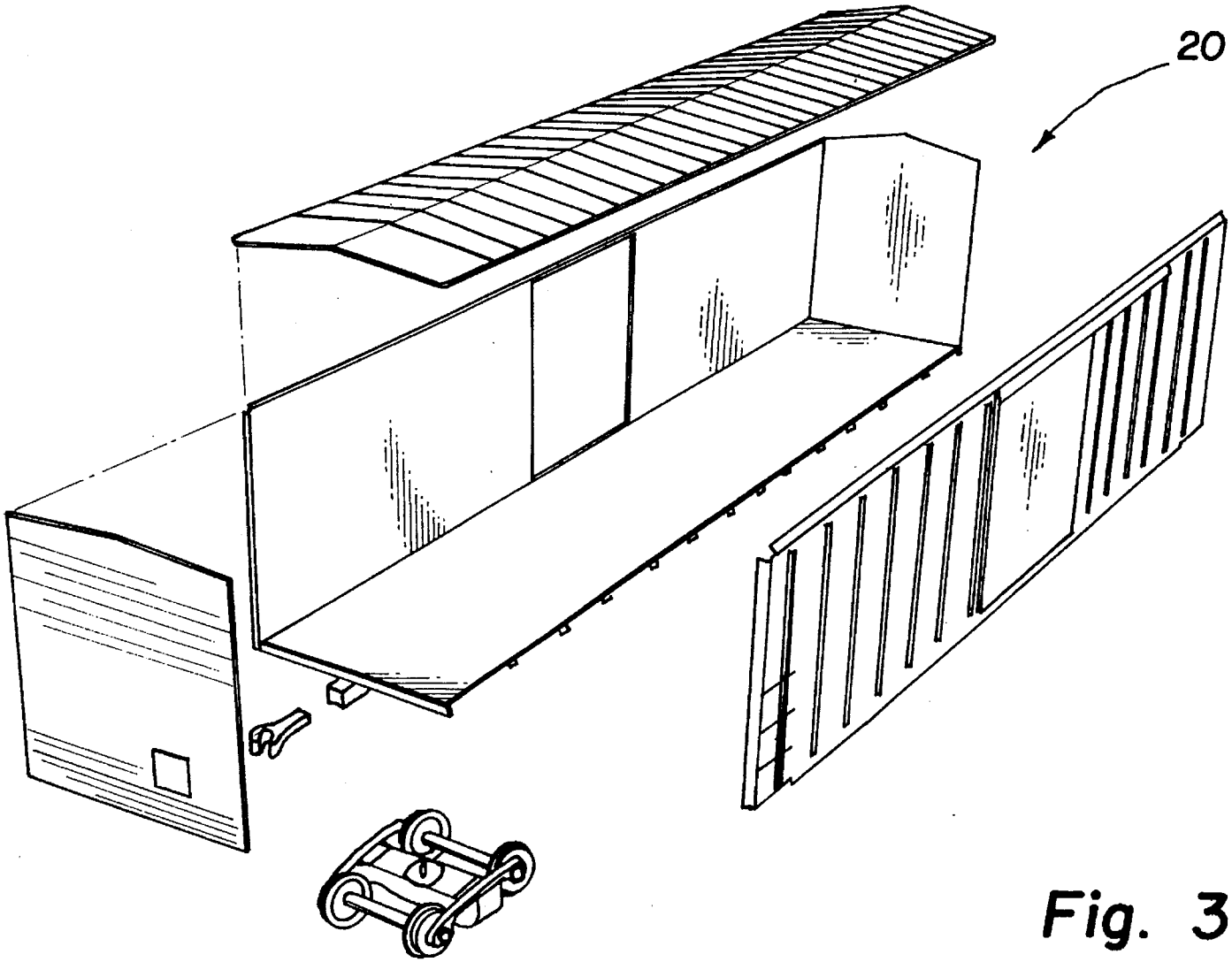
Figure 3C:
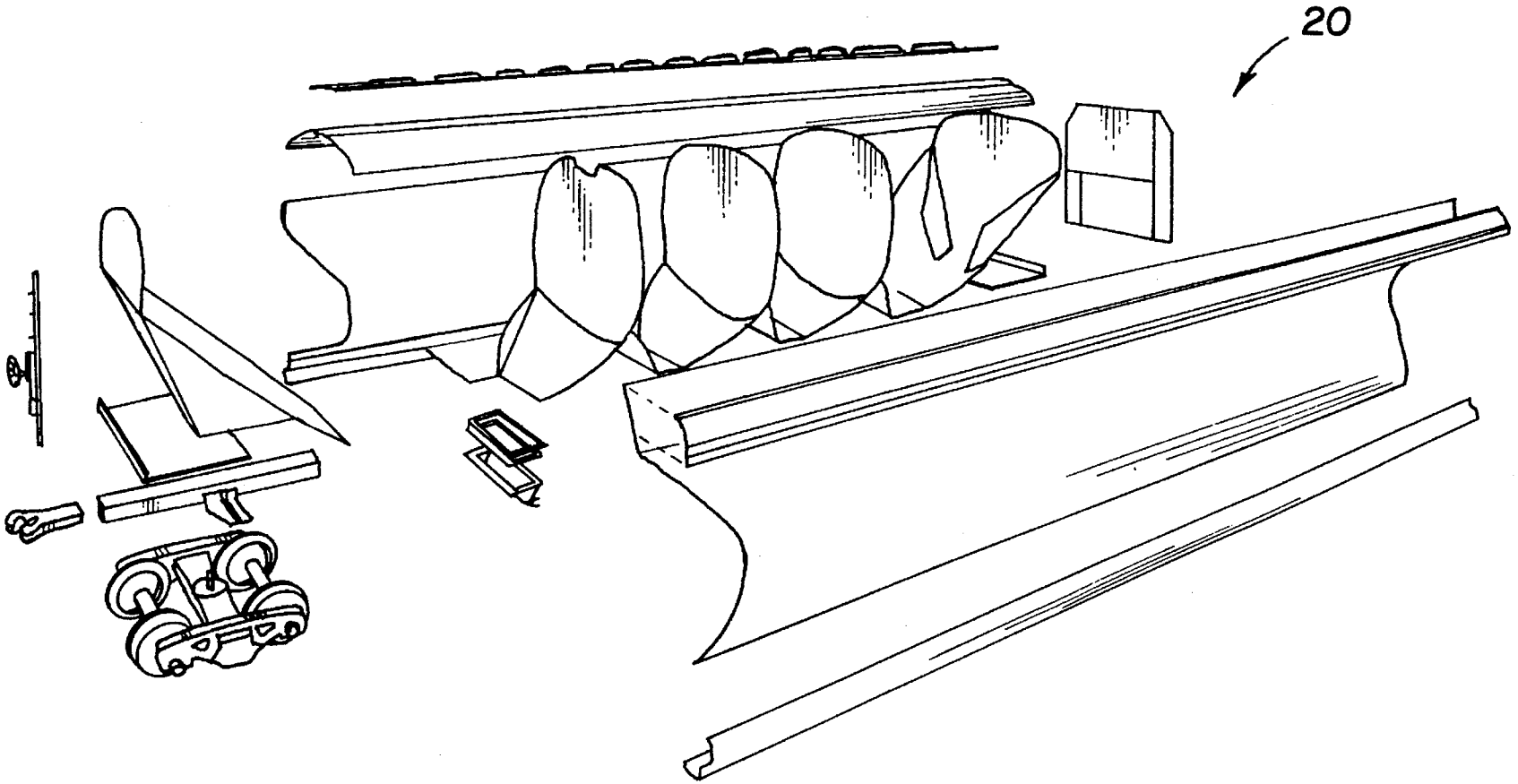

FIGS. 3A, 3B, and 3C are representative illustrations of the types of open top hoppers, box cars, and tank cars. As shown in FIG. 3A, open top hoppers are typically used to transport materials that can be exposed to the environment, such as coal, ballast, and ore and are typically called coal cars, ballast cars, and ore cars respectively.

Figure 4A:
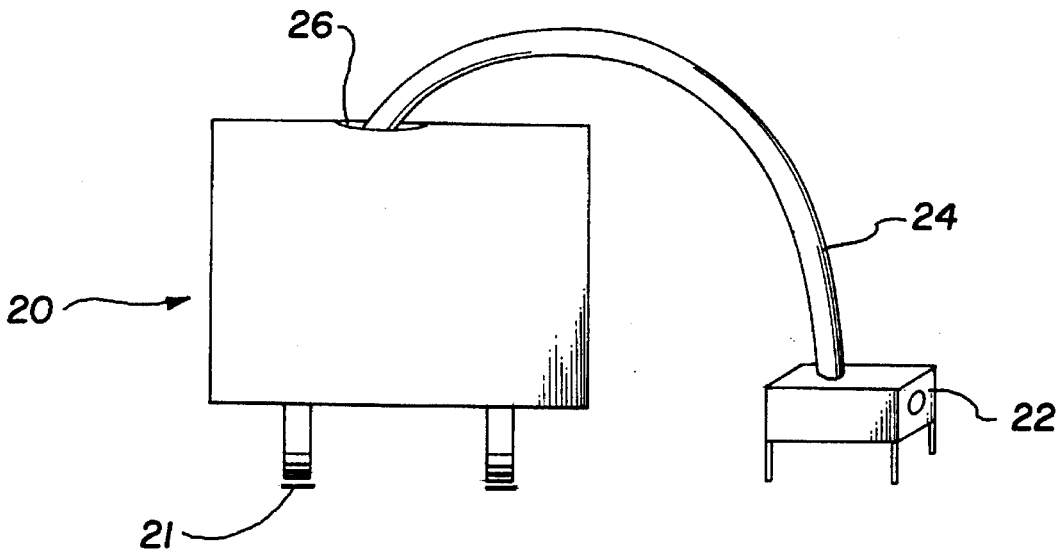
FIGS. 4A, 4B, and 4C shows the preferred method of removing excess debris using standard industrial vacuum equipment.
Figure 4B:
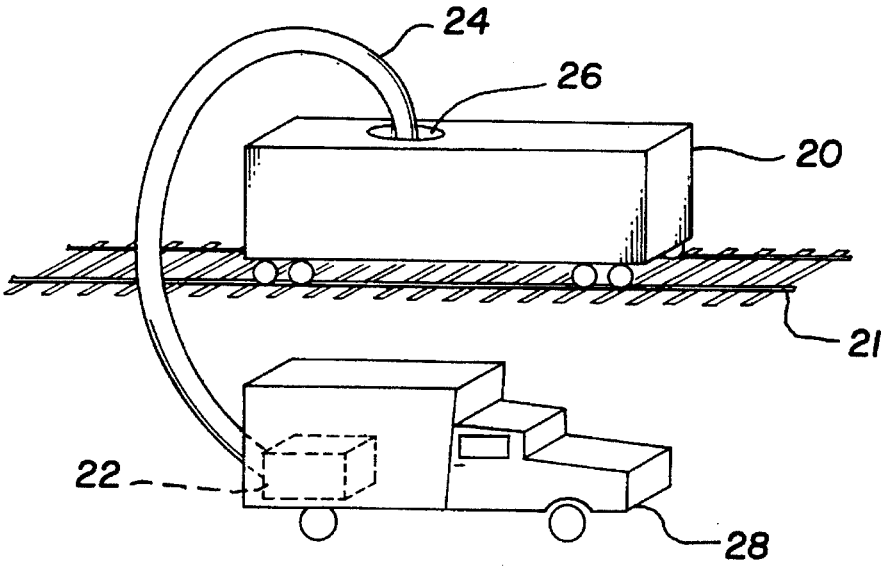
Figure 4C:
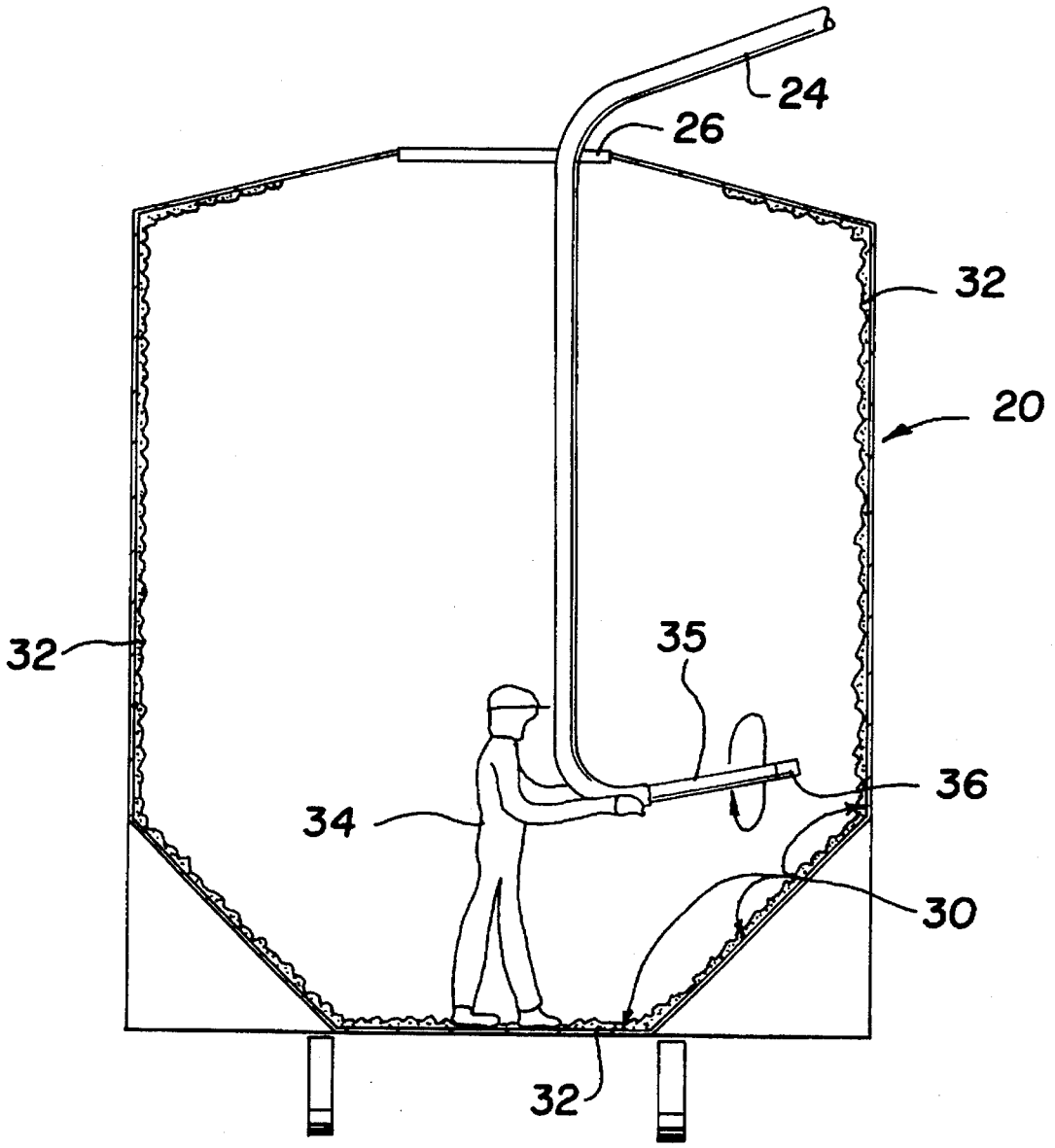

FIGS. 4A, 4B, and 4C show the preferred method of removing excess debris using standard industrial vacuum equipment, such as the equipment manufactured by Vactor (Model Numbers 800–1200). Note that rail car 20 shown is intended to be representative of all rail cars 20 in general and, more particularly, of rail cars shown in FIGS. 2A and 2B and FIGS. 3A, 3B, and 3C. FIGS. 4A and 4B show a frontal and cross-sectional view of the outside of rail car 20 with vacuum equipment 22 positioned outside of rail car 20 and vacuum hose 24 extending from vacuum equipment 22 outside of rail car 20 inside rail car 20 through an opening 26 in rail car 20. Vacuum equipment 22 is typically positioned inside a truck 28 of some sort (as shown in FIG. 4B), which allows for vacuum equipment 22 to be easily moved from one rail car 20 to the next rail car 20 (not shown) as well as for excess material 32 (as shown in the following FIG. 4C) removed from rail car 20 to be contained and transported to the proper disposal or recycling site. While not preferable at the moment, it is also possible for vacuum equipment 22 to be positioned in a stable location along rail road track 21 and rail cars 20 that needed to be cleaned could be positioned alongside vacuum equipment 22. As shown in FIG. 4C, a human operator 34 generally directs nozzle 36, which is attached to one end of vacuum hose 24, in a random or preselected pattern to knock off excess material 32 from interior surface 30 of rail car 20. While a wide variety of suction pressures may be used, preferred methods operate at approximately 1,000 to 2,500 c.f.m. The suction selected must be strong enough to remove heavier items and small enough to allow easy movement across the surface being vacuumed. Vacuum hose 24 preferably used in all vacuum operations are generally two to eight inches in diameter, depending upon the amount and relative size of excess material 32. Attachment 35, which are preferrably comprised of aluminum, are preferably attached to vacuum hose 24, which allows interior surfaces 30 (e.g., vertical and bottom surfaces) of rail car 20 to be vacuumed in quick and efficient fashion. In particular, attachment 35 provides a handle that allows human operator 24 to direct the suction more easily. Nozzle 36 and/or attachment 35 may have a flared or round entrance. Nozzle 36 is preferably attached to attachment 35, but may be attached directly to vacuum hose 24 itself. In addition to the actual removal of excess material 32, which is necessary to properly clean rail car 20, this step also allows for better visibility for all cleaning operations that follow, especially when the surface cleaned is an interior surface (e.g., interior surface 30) and human operator 34 is removing excess material 32 from a closed or confined space (e.g., inside a covered hopper or box car).

Figure 5A:
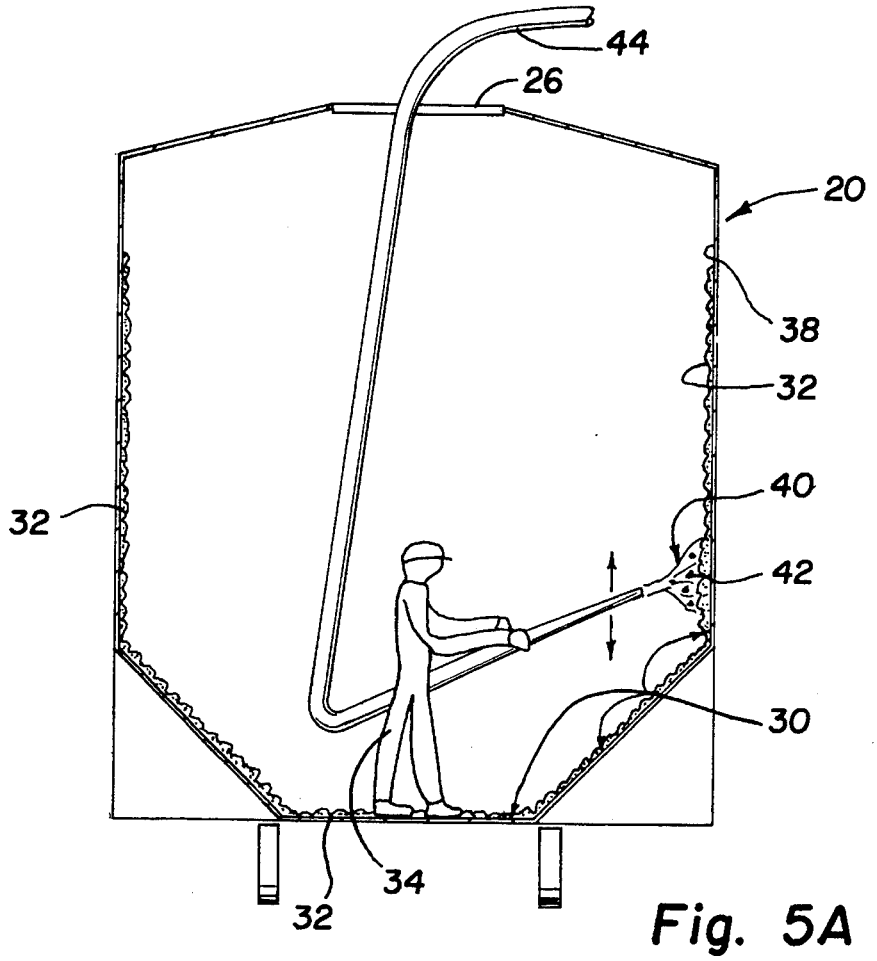
FIGS. 5A and 5B shows the preferred method of removing clinging or otherwise persistent debris from interior and exterior surfaces of rail cars respectively.
Figure 5B:
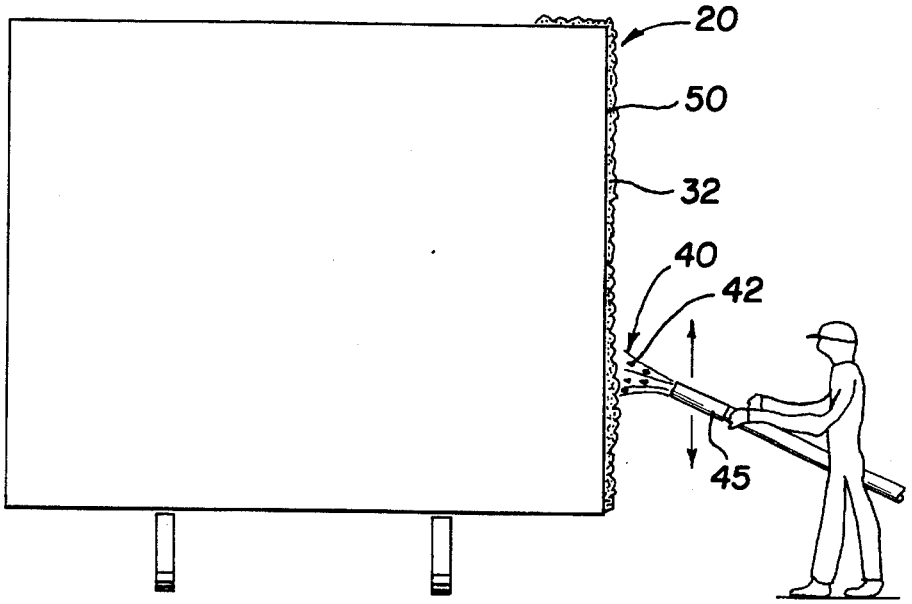

FIGS. 5A and 5B show the preferred method of removing clinging or otherwise persistent debris or excess material 32 remaining on the interior surface 30 and exterior surface 50 (in FIGS. 5A and 5B respectively) of rail car 20 with forced air 40. As discussed above, forced air 40 is preferably augmented by the forced application of abrasive media 42, but may be used exclusively in some applications. Forced air 40 is preferably augmented with abrasive media 42 in an alternating fashion, but can be adjusted depending upon the nature of the excess material 32 and its location on interior surface 30 or exterior surface 50 (e.g., in a hard to get to place). Blasting machinery creates a force to exert via forced air 40 and/or abrasive media 42 via hose 44 against excess material 32 positioned on the surface(s) of rail car 20 to dislodge excess material 32 from surface(s) of rail car 20. The abrasiveness and the nature (e.g., organic, toxicity) of abrasive media 42 and the pressure that abrasive media 42 is applied to interior surface 30 and may vary depending upon the nature of debris or excess material 32 (e.g., resilience, chemical make-up, etc.), the strength of interior surface 30 or exterior surface 50, and the resilience of lining 38 on interior surface 30 or exterior surface 50. In most cases, abrasive media 42 must be hard and heavy enough and the force exerting abrasive media 42 against interior surface 30 must be strong enough to remove (e.g., knock or chip) excess material 32 from interior surface 30. For example, if excess material 32 comprises cement, abrasive media 42 preferably comprises granite. If excess material 32 comprises sand, flour, or sugar, abrasive media 42 preferably comprises a fine silica substance. Fine silica sand has the added advantage of being a registered inert material with no harmful or known side effect listed on the Material Safety Data Sheet (commonly referred to as "M.S.D.S."), which is important if the silica sand is accidentally ingested for any reason. Please note, however, human operators 34 should wear protective equipment and face masks to prevent fine silica sand from being inhaled, because it is believed to be hazardous if inhaled. Abrasive media 42 comprised of dry ice may be used to remove excess materials 32 comprising foodstuffs, but is not generally preferred. In addition, abrasive media 42 is preferably easy to see and distinguish from excess material 32, which allows quality inspectors to easily inspect rail car 20. In addition, it is also preferable that abrasive media 42 be easily removed from interior surface 30 of the rail car 20. Depending upon the amount or thickness of residual excess material 32 clinging to interior surface 30 or exterior surface 50, the force, the pattern, and the abrasive media 42 used can be altered. If the rail car 20 has lining 38 (e.g., paint, epoxy, etc.), a fine abrasive media 42 (e.g., #40 to #100 processed silica and/or "ferina" is preferably used to remove the residue of food products for lined rail cars; "ferina" is a by-product of fine, hard food products, such as wheat; #20 silica or #20 granite, etc. is preferably used to remove the residue from industrial products typically found in unlined rail cars) is used and the pressure at which abrasive media 42 is applied is adjusted, so that the lining 38 is not damaged. Abrasive media 42 is generally circular beads, droplets, pellets, or grains. The beads preferably have a smooth, outer surface for most applications to minimize damage to the surface cleaned. The beads, however, may have a sharp or rough outer surface for some applications.

Figure 5C:
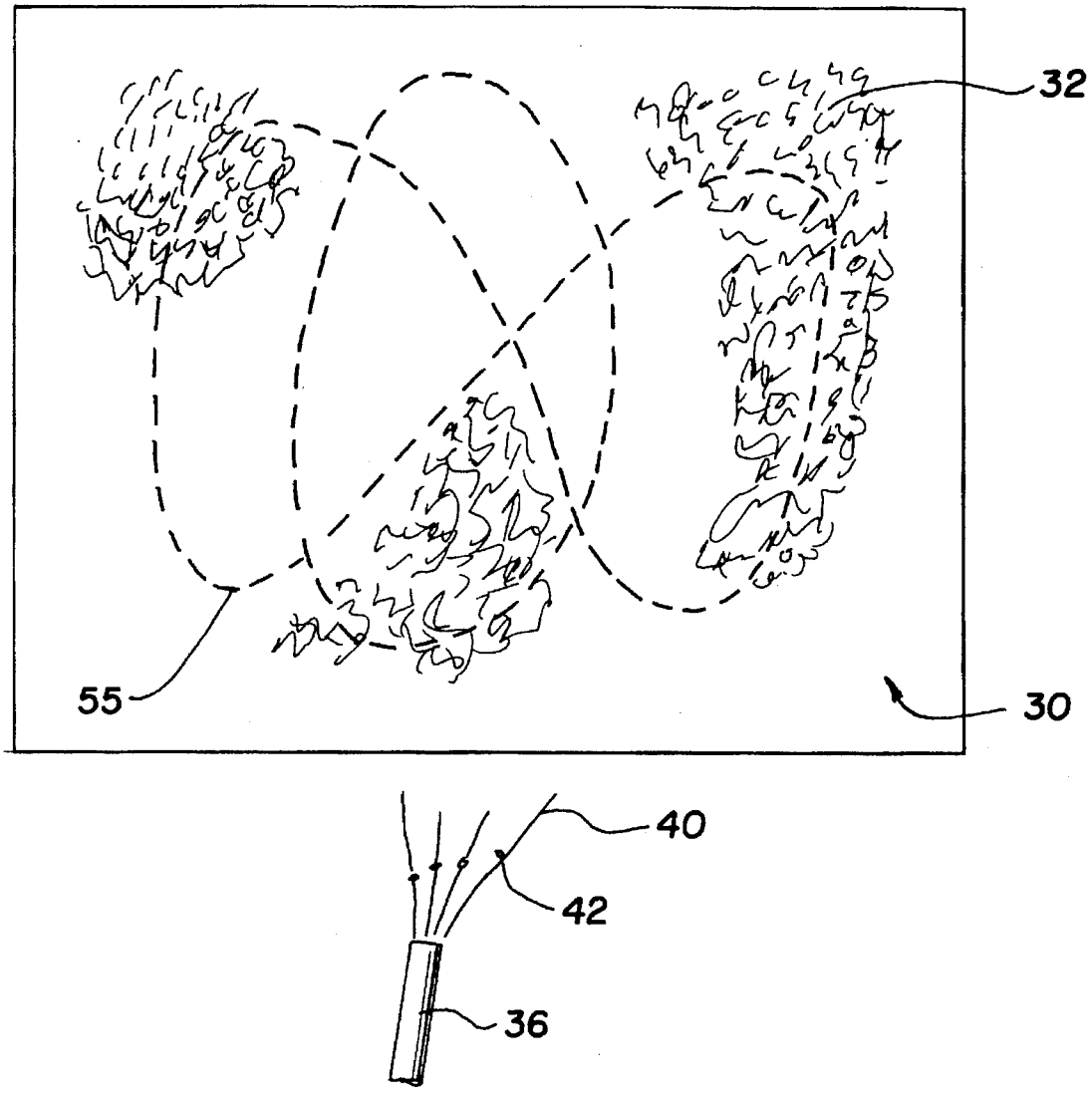
FIG. 5C shows the criss-crossed pattern air and abrasive media is applied on interior and exterior surfaces of rail cars.

As shown in FIG. 5C, abrasive media 42 is preferably applied in a criss-crossed pattern 55 (e.g., back-and-forth, left-to-right, up-and-down), so abrasive media 42 via nozzle 36 is not focused in one place for an extended period of time, which prevents lining 38 (which is not evident in FIG. 5C, because it is underneath excess material 32) and/or interior surface 30 and exterior surface 50 from being damaged. Nozzle 36 is preferably equipped with a flared or angled end (e.g., #5 nozzle), which enables air 40 and/or abrasive media 42 to be used in a cutting and dislocating fashion. Nozzle 36 can be altered, depending upon the nature of debris or excess material 32. Nozzle 36 is preferably attached to a four inch diameter, rubber hose (e.g., #7 static resistant, corrugated hose), which is preferably flexible in cold weather and strong and thick enough to not crack in cold weather. In fact, other attachments could be attached to hose 44 to perfect the removal of excess material 32. For instance, a four foot aluminum extension off of hose 44 could be used, which provides human operator 34 (in FIGS. 5A and 5B) a firm handle to hold in order to direct hose 44 and the spray of air 40 and/or abrasive media 42.

Figure 6:
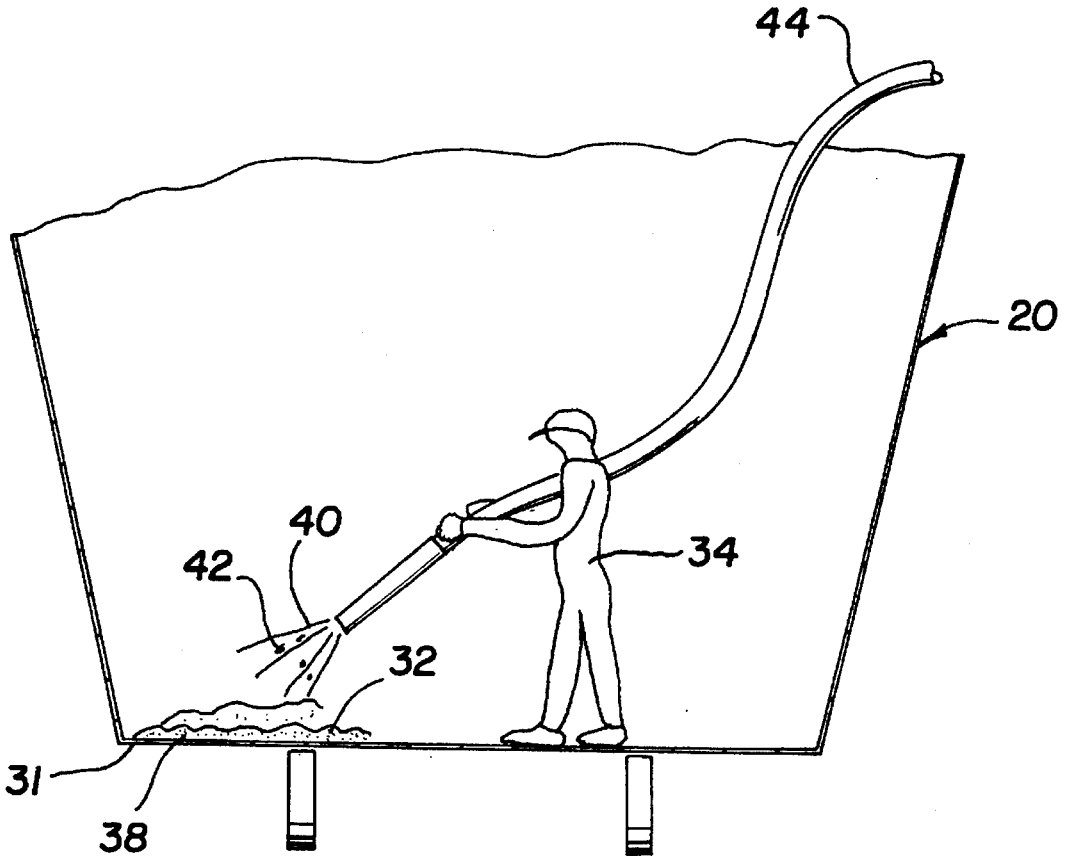
FIG. 6 shows the operation of preferred systems and methods on canvass covered surfaces, which are typically found in airslide covered hopper rail cars.

Referring to FIG. 6, if the rail car is equipped with a canvass belt, it can be cleaned without intrusion or damage using this system. FIG. 6 shows the operation of preferred systems and methods on canvass covered surfaces 31, which are typically found in airslide covered hopper rail cars 20. In particular, human operator 34 applies abrasive media 42 and/or forced air 40 onto canvass covered surface 31 via hose 44 to remove excess material 32 and otherwise clean canvass covered surface 31.

Figure 7A:
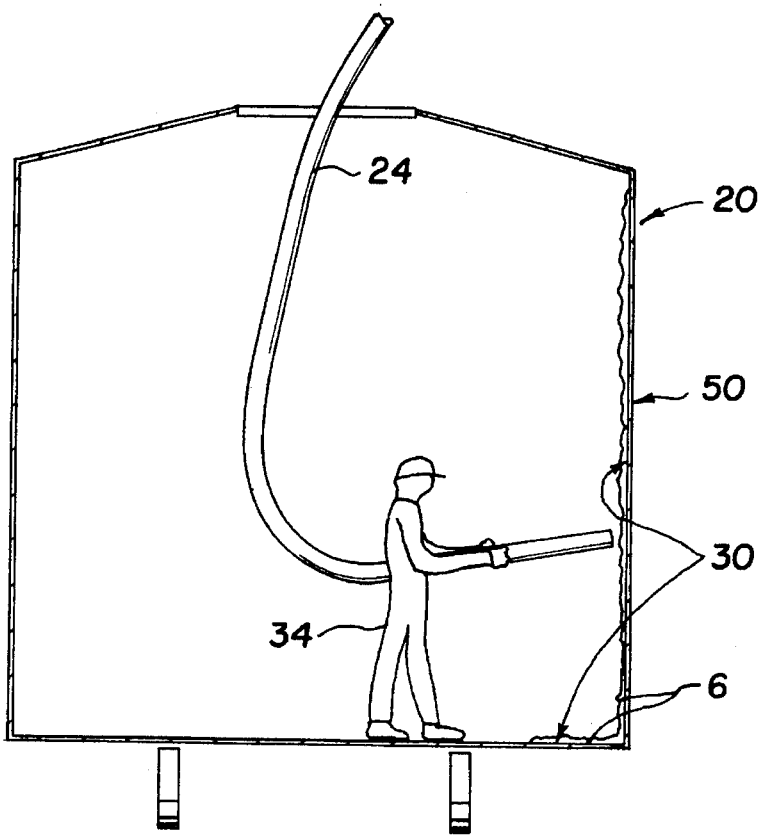
FIG. 7A and 7B show the vacuuming up of excess material from interior surface of rail cars and wiping down the clean surface of a rail car with a rag.
Figure 7B:
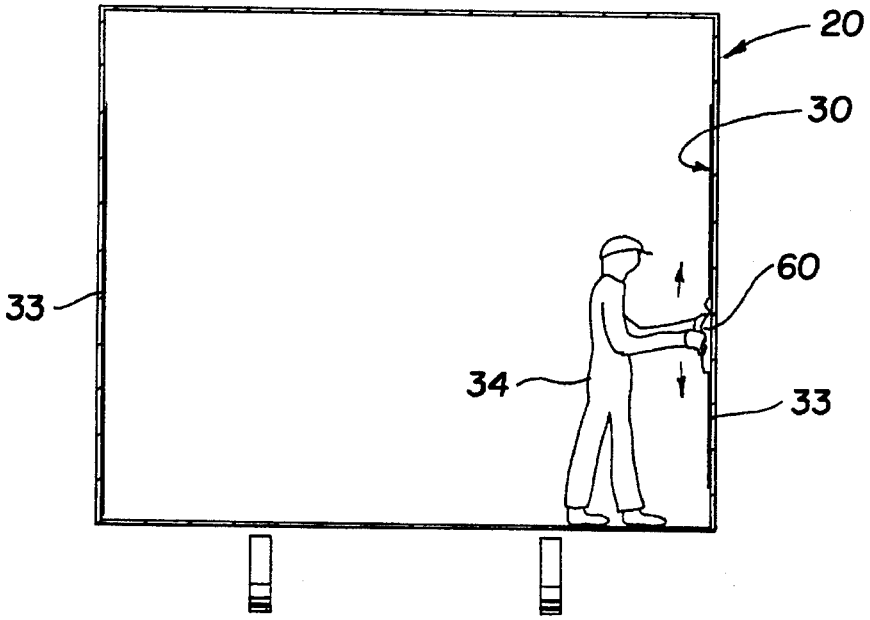

FIGS. 7A and 7B show the vacuuming up excess material 32 and abrasive media 42 from interior surface 30 of rail car 20 and wiping down interior surface 30 of rail car 20 with rag 60. In particular, FIG. 7A shows the preferred method of removing excess dust and debris 6, as identified in FIG. 1, which has been knocked loose with the previous steps 2 and 4 (as shown in FIG. 1) or leftover from the first step. When silica sand is used as abrasive media 42, as discussed above, it has the added advantage that it is easily detected on interior lining 38 of most rail cars 20 and easily removed. If the rail car 20 is used to transport foodstuffs, surfaces 30 and 50 can be wiped down with rag 60 to remove excess dust from any areas where light dust 33 may still be clinging to surfaces. In addition, as shown in FIG. 7B, the surface of the rail car can be wiped down with a dry rag (e.g., paper or cloth) and a damp rag. A rag could also be used to apply a sterilizing agent (e.g., Sana T 10 or comparable, approved, food-grade cleansers).

FURTHER MODIFICATIONS AND VARIATIONS

Although the invention has been described with reference to a specific embodiment, this description is not meant to be construed in a limiting sense. As described above, various modifications of the disclosed embodiment as well as alternate embodiments of the invention will become apparent to persons skilled in the art upon reference to the description of the invention. Accordingly, it should be understood that the modifications and variations suggested above and below are not intended to be exhaustive. These examples help show the scope of the inventive concepts, which are covered in the appended claims. The appended claims are intended to cover these modifications and alternate embodiments. In particular, following the above teachings, other abrasive media could be used in addition to those specified above, depending upon the nature of the cleaning assignments. In addition, the processes and systems discussed above could be automated.

What is claimed is:

1. A method of cleaning a rail car that is used to haul a freight, comprising:

step (a) vacuuming a material clinging to at least one interior surface of said rail car that is used to haul said freight;

step (b) blasting air against said material still clinging to said at least one interior surface of said rail car that is used to haul said freight to dislodge said material clinging to said at least one interior surface of said rail car that is used to haul said freight;

step (c) vacuuming said material dislodged by step (b) and remaining on said at least one interior surface after steps (a) and (b); and step (d) wiping off said material remaining on said at least one interior surface after steps (a), (b), and (c) and applying a sterilizing agent to said at least one interior surface after steps (a), (b), and (c).

2. The method of cleaning a rail car that is used to haul a freight of claim 1, wherein said vacuuming uses a suction of approximately 1,000 to 2,500 c.f.m.

3. The method of cleaning a rail car that is used to haul a freight of claim 1, further comprising:

step (b1) blasting an abrasive media against said material clinging to said at least one interior surface of said rail car that is used to haul said freight to dislodge said material clinging to said at least one interior surface of said rail car that is used to haul said freight with minimal damage to said at least one interior surface of said rail car.

4. The method of cleaning a rail car that is used to haul a freight, of claim 3, wherein steps (b) and (b1) are alternated.

5. The method of cleaning a rail car that is used to haul a freight of claim 3, wherein said abrasive media is selected from a group consisting of sand, silica sand, gravel, limestone, birdseed, walnut, wheat, granite, sugar, mill tailings, dry ice, and any combination thereof.

6. The method of cleaning a rail car that is used to haul freight of claim 3, wherein a lining covers a portion of said at least one interior surface of said rail car that is used to haul freight and wherein said blasting does not remove said lining.

7. The method of cleaning a rail car that is used to haul freight of claim 6, wherein said abrasive media is selected from the group consisting of sand, silica sand, gravel, limestone, birdseed, walnut, wheat, granite, sugar, mill tailings, dry ice, and any combination thereof.

8. The method of cleaning a rail car that is used to haul a freight of claim 1, wherein said blasting air is approximately at 85 to 150 p.s.i.

9. The method of cleaning a rail car that is used to haul a freight of claim 1, wherein said sterilizing agent is a food-grade cleanser.

10. The method of cleaning a rail car that is used to haul a freight of claim 1, wherein said rail car that is used to haul freight is selected from a group consisting of covered hoppers, open hoppers, box cars, tank cars, autoracks, locomotives, and flat cars.

11. The method of cleaning a rail car that is used to haul a freight of claim 1, wherein said material is selected from a group consisting of agricultural products, foodstuffs, packaged goods, and any combination thereof.

12. A method for cleaning a rail car that is used to haul a freight having at least one interior surface, comprising:

step (a) vacuuming a material clinging to said at least one interior surface of said rail car that is used to haul said freight; and step (b) blasting an abrasive media against said material clinging to said at least one interior surface of said rail car that is used to haul said freight to dislodge said material from said at least one interior surface of said rail car that is used to haul said freight with minimal damage to said at least one surface of said rail car that is used to haul said freight;

step (c) vacuuming said material dislodged by step (b) and remaining on said at least one interior surface after steps (a) and (b); and step (d) wiping off said material remaining on said at least one interior surface after steps (a), (b), and (c) and applying a sterilizing agent to said at least one interior surface after steps (a), (b), and (c).

13. The method of cleaning a rail car that is used to haul a freight of claim 12, wherein said material is further selected from a group consisting of fertilize, sand, cement, petroleum coke products, dry petroleum products, limestone, soda ash, pot ash, grain products, vegetables, sugar, flour, bentonite, sunflower seeds, and flax.

14. The method of cleaning a rail car that is used to haul a freight of claim 12, wherein said vacuuming uses a suction of approximately 1,000 to 2,500 c.f.m.

15. The method of cleaning a rail car that is used to haul a freight of claim 12, wherein said abrasive media is selected from a group consisting of sand, silica sand, gravel, limestone, birdseed, walnut, wheat, granite, sugar, mill tailings, dry ice, and any combination thereof.

16. The method of cleaning a rail car that is used to haul a freight of claim 12, wherein said blasting of said abrasive media is approximately at 85 to 150 p.s.i.

17. The method of cleaning a rail car that is used to haul a freight of claim 12, wherein said sterilizing agent is a food-grade cleanser.

18. The method of cleaning a rail car that is used to haul a freight of claim 12, wherein said rail car that is used to haul freight is selected from a group consisting of covered hoppers, open hoppers, box cars, tank cars, autoracks, locomotives, and flat cars.

19. The method for cleaning a rail car that is used to haul a freight having at least one interior surface of claim 12, wherein said material is selected from a group consisting of agricultural products, foodstuffs, packaged goods, and any combination thereof.

20. A method of cleaning at least one interior surface of a rail car that is used to haul a freight to remove a residual material left clinging to said at least one interior surface of said rail car that is used to haul said freight after a bulk of said freight transported by said rail car that is used to haul said freight is removed, comprising:

step (a) vacuuming said residual material that is loose and clinging to said at least one interior surface of said rail car that is used to haul said freight;

step (b) blasting an abrasive media against said residual material that is clinging to said at least one interior surface of said rail car that is used to haul said freight to dislodge said residual material from said at least one interior surface of said rail car with minimal damage to said at least one interior surface of said rail car that is used to haul said freight, wherein a lining covers a portion of said at least one interior surface of said rail car that is used to haul said freight and wherein said blasting does not remove said lining;

step (c) vacuuming said residual material that is loose and dislodged by step (b) and remaining on said at least one interior surface after steps (a) and (b); and step (d) wiping off said material remaining on said at least one interior surface after steps (a), (b), and (c) and applying a sterilizing agent to said at least one interior surface after steps (a), (b), and (c).

21. The method of cleaning at least one interior surface of a rail car that is used to haul a freight to remove a residual material left clinging to said at least one interior surface of said rail car that is used to haul said freight after a bulk of said freight transported by said rail car that is used to haul said freight is removed of claim 20, wherein said residual material is selected from a group consisting of agricultural products, foodstuffs, packaged goods, and any combination thereof.

22. The method of cleaning at least one interior surface of a rail car that is used to haul a freight to remove a residual material left clinging to said at least one interior surface of said rail car that is used to haul said freight after a bulk of said freight transported by said rail car that is used to haul said freight is removed of claim 20, wherein said residual debris is selected from a group consisting of fertilizer, sand, cement, petroleum coke products, dry petroleum products, limestone, soda ash, pot ash, grain products, vegetables, sugar, flour, bentonite, sunflower seeds, and flax.

23. The method of cleaning at least one interior surface of a rail car that is used to haul a freight to remove a residual material left clinging to said at least one interior surface of said rail car that is used to haul said freight after a bulk of said freight transported by said rail car that is used to haul said freight is removed of claim 20, wherein said vacuuming uses a suction of approximately 1,000 to 2,500 c.f.m.

24. The method of cleaning at least one interior surface of a rail car that is used to haul a freight to remove a residual material left clinging to said at least one interior surface of said rail car that is used to haul said freight after a bulk of said freight transported by said rail car that is used to haul said freight is removed of claim 20, wherein said abrasive media is selected from a group consisting of sand, silica sand, gravel, limestone, birdseed, walnut, wheat, granite, sugar, mill tailings, dry ice, and any combination thereof.

25. The method of cleaning at least one interior surface of a rail car that is used to haul a freight to remove a residual material left clinging to said at least one interior surface of said rail car that is used to haul said freight after a bulk of said freight transported by said rail car that is used to haul said freight is removed of claim 20, wherein said blasting of said abrasive media is approximately at 85 to 150 p.s.i.

26. The method of cleaning at least one interior surface of a rail car that is used to haul a freight to remove a residual material left clinging to said at least one interior surface of said rail car that is used to haul said freight after a bulk of said freight transported by said rail car that is used to haul said freight is removed of claim 20, comprising:

step (c1) blasting air against said residual material clinging to said interior surfaces of said rail car that is used to haul freight to dislodge said residual material clinging to said interior surfaces of said rail car that is used to haul freight.

27. The method of cleaning at least one interior surface of a rail car that is used to haul a freight to remove a residual material left clinging to said at least one interior surface of said rail car that is used to haul said freight after a bulk of said freight transported by said rail car that is used to haul said freight is removed of claim 20, wherein said abrasive media is selected from a group consisting of sand, silica sand, gravel, limestone, birdseed, walnut, wheat, granite, sugar, mill tailings, dry ice, and any combination thereof.

* * * * *